United States Patent [19]

Umahashi et al.

[11] 4,183,655

[45] Jan. 15, 1980

[54] CLEANING MEANS FOR IMAGE TRANSFER UNIT IN ELECTROPHOTOGRAPHIC COPYING MACHINES

[75] Inventors: Minoru Umahashi, Sagamihara; Hideo Yamazaki, Tokyo; Mitsuo Hasebe; Tadashi Yamashita, both of Yokohama, all of Japan

[73] Assignee: Ricoh Company, Ltd., Tokyo, Japan

[21] Appl. No.: 907,976

[22] Filed: May 22, 1978

Related U.S. Application Data

[63] Continuation of Ser. No. 727,853, Sep. 29, 1976, abandoned.

[30] Foreign Application Priority Data

Oct. 7, 1975 [JP] Japan ..... 50-120950

[51] Int. Cl.[2] ..... G03G 15/00

[52] U.S. Cl. ..... 355/3 TR; 15/1.5 R; 118/652; 355/15

[58] Field of Search ..... 355/3 TR, 15; 118/652; 15/1.5, 256.51, 256.52

[56] References Cited

U.S. PATENT DOCUMENTS

| | | | |
|---|---|---|---|
| 3,679,453 | 7/1972 | Katagiri et al. | 96/1 LY X |
| 3,700,328 | 10/1972 | Davidge et al. | 118/652 X |
| 3,713,736 | 1/1973 | Sargis | 355/15 |
| 3,781,105 | 12/1973 | Meagher | 355/3 TR |
| 3,819,263 | 6/1974 | Draugelis et al. | 355/15 X |
| 3,847,478 | 12/1974 | Young | 355/3 TR |
| 3,892,481 | 7/1975 | Schaefer et al. | 355/10 |
| 3,951,653 | 4/1976 | Matsumoto | 96/1 LY X |

*Primary Examiner*—R. L. Moses

*Attorney, Agent, or Firm*—Cooper, Dunham, Clark, Griffin & Moran

[57] ABSTRACT

An image transfer unit provided with cleaning means for use in an electrophotographic copying machine comprising an electrically conductive transfer roller disposed in abutting relationship with a photosensitive member, an electrically conductive, rotatable cleaning means disposed in abutting relationship with the transfer roller, and electrical bias means connected with the cleaning means and having a switchable polarity. During a transfer step, a bias voltage of opposite polarity to that of the toner is applied to the transfer roller through the cleaning means. At this time, toner attaching to the transfer roller is electrostatically transferred onto the cleaning means. During a cleaning step, a bias voltage of the same polarity as the toner is applied to the cleaning means, whereby the toner attaching thereto is transferred back to the photosensitive member through the transfer roller. The toner which is transferred back to the photosensitive member is removed by separate cleaning means.

10 Claims, 8 Drawing Figures

CLEANING MEANS FOR IMAGE TRANSFER UNIT IN ELECTROPHOTOGRAPHIC COPYING MACHINES

This is a continuation, of application Ser. No. 727,853 filed Sept. 29, 1976 now abandoned.

BACKGROUND OF THE INVENTION

The invention relates to an image transfer unit for use in an electrophotographic copying machine which incorporates a transfer roller to which a bias voltage is applied.

An image transfer unit of the kind described is confronted with the problem of smearing of the back side of the transfer sheets that results from the deposition on the surface of the transfer roller of a toner, which is floating in the internal space of the copying machine or which is driven from non-image areas on a photosensitive member. The deposited toner contaminates the back surface of the transfer sheet which is held between the photosensitive member and the transfer roller during the image transfer step. Therefore, it is necessary to provide some cleaning unit for removing toner which is deposited on the transfer roller in order to prevent a smearing of the back side of the transfer sheet.

Conventional means for cleaning the transfer roller comprises a blade which is brought into abutting relationship therewith to scrape any toner therefrom, or comprises a rotatable brush which is urged against the transfer roller to wipe off any toner thereon. These arrangements require some form of toner processing means which collects the separated toner or which prevents redeposition of the separated toner onto the transfer roller.

SUMMARY OF THE INVENTION

In accordance with the invention, there is provided an image transfer unit which comprises an electrically conductive image transfer roller disposed in abutting relationship with a photosensitive member, an electrically conductive, rotatable cleaning means disposed in abutting relationship with the image transfer roller, and electrical bias means connected with the cleaning means and having a switchable polarity. During an image transfer step, a bias voltage is applied to the transfer roller of the opposite polarity from that of the toner which forms the visual image, causing the visual image to be transferred onto a copy sheet. Toner attaching to the transfer roller is electrostatically transferred onto the cleaning means. During a cleanng step, a bias voltage of the same polarity as the toner is applied to the cleaning means to transfer the toner which attaches to the cleaning means back to the photosensitive member through the transfer roller. Since the photosensitive member is charged to the opposite polarity from the toner, it readily attracts the toner. The toner which is transferred back to the photosensitive member is removed by a further cleaning unit which is associated with the photosensitive member. In this manner, the image transfer unit according to the invention represents simple means which reliably removes any toner attaching to the transfer roller.

Therefore, it is an object of the invention to provide an improved image transfer unit having cleaning means associated with an image transfer roller.

It is another object of the invention to provide an image transfer unit of the kind described which is simple in construction and capable of reliably removing any toner attaching to the transfer roller.

The above and other objects of the invention will become apparent as the description proceeds with reference to the drawings.

DETAILED DESCRIPTION OF PREFERRED EMBODIMENTS

Figure 1:
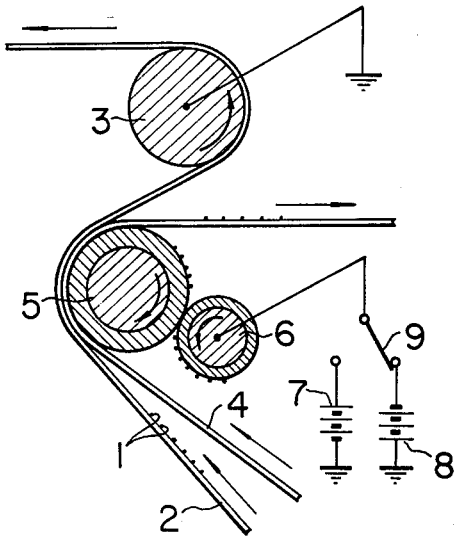
FIG. 1 is a schematic view of one embodiment of the invention.

Referring to FIG. 1, there is shown a photosensitive member 2 in the form of a belt which carries a developed toner image 1 thereon. The belt 2 is adapted to be driven by a grounded roller 3 to run along a path indicated by appropriate arrows, which includes an image transfer roller 5. A bias voltage of the opposite polarity from that of the toner is applied to the transfer roller 5, and as a portion of the belt which carries the toner image approaches the transfer roller 5, a transfer sheet 4 is fed into superimposed and abutting relationship with the belt, whereby the toner image 1 is transferred onto the transfer sheet 4.

The image transfer roller 5 comprises a metallic roller having its surface coated with an electrically conductive rubber material, and a bias voltage is applied thereto through a cleaning roller 6 having a similar surface coating of an electrically conductive rubber material which is disposed in abutting relationship with the surface of the transfer roller 5. The cleaning roller 6 is alternatively connected with a pair of d.c. high voltage sources 7, 8 of opposite polarities through a switch 9. The cleaning roller 6 has a diameter which is reduced as compared with the diameter of the transfer roller 5 so that contact occurs therebetween at varying points during the rotation thereof.

Figure 2:
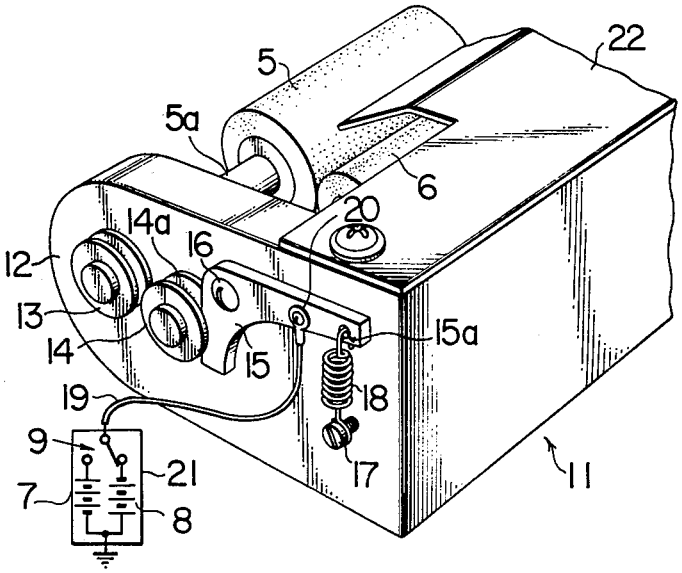
FIG. 2 is a fragmentary perspective view of the embodiment shown in FIG. 1.

FIG. 2 is a fragmentary perspective view showing a specific construction. The transfer roller 5 is mounted on a metal shaft **5*a* which is mounted in a pair of insulating sideplates 12 of a transfer unit by means of bearings 13. The cleaning roller 6 has its support shaft also rotatably mounted in the sideplates 12 by means of bearings 14, which however are displaceably mounted. An electrically conductive L-shaped lever 15 is rockably mounted on one of the sideplates 12 by a screw 16, and a coiled tension spring 18 is disposed between an opening 15*a* formed in the end of one limb of the lever 15 and a screw 17 fixed to the sideplate 12, thus urging the lever 15 to rotate clockwise about the screw 16. The other limb of the lever 15 engages a groove 14*a* formed in the bearing 14 and is thus biased by the spring 18 to urge the cleaning roller into abutting engagement with the transfer roller 5. One end of a lead wire 19 is secured to the lever 15 by a set screw 20, and the other end of the lead wire 19 is connected with a power supply assembly 21. The transfer unit also includes a cover 22 which also serves as a guide for the transfer sheets when separated from the transfer roller 5**.

Figure 3:
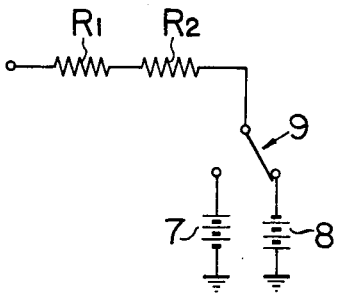
FIG. 3 is a circuit diagram showing the electrical equivalent circuit of the embodiment shown in FIGS. 1 and 2.

FIG. 3 shows the electrical equivalent circuit of the above embodiment. A character $R_2$ represents the resistance of the cleaning roller which is substantially equal to or greater than the resistance $R_1$ of the transfer roller. As a consequence, when a bias voltage is applied from the cleaning roller to the transfer roller during an image transfer step, and a portion of the developer toner on the photosensitive member which lies outside the region of a transfer sheet initially attaches to the transfer roller, the toner which attaches to the transfer roller is then directly transferred, for the most part, to the cleaning roller because of the relative magnitudes of the resistances of the transfer roller and the cleaning roller, and accordingly the greater attraction of the higher voltage on the cleaning roller than that on the transfer roller (it will be appreciated that the voltage on the cleaning roller will be still higher by an amount corresponding to the voltage drop when both are of the same resistance). As a result, the toner which remains attached to the transfer roller is considerably reduced, thereby effectively preventing a smearing of the back surface of the transfer sheet by contact with the transfer roller.

After completion of an image transfer step, the bias voltage is changed by switch 9 to the opposite polarity from the polarity utilized during the transfer step, that is, to the same polarity as the toner. Thereupon, the toner attaching to the cleaning roller will be transferred to the lower voltage transfer roller and then to the photosensitive member which is charged to the same polarity as the toner, whereby the surface of both the transfer roller and the cleaning roller will revert to the clean condition which they assumed before the transfer step took place. The toner attaching to the photosensitive member is carried thereon to a cleaning station where it is removed from the surface of the photosensitive member.

Figure 4:
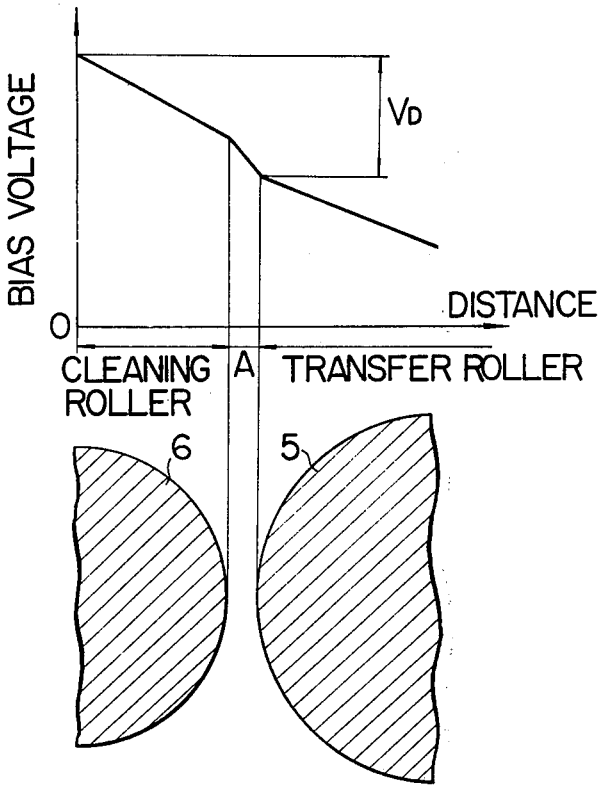
FIG. 4 is a schematic illustration, graphically showing the transfer of toner between the cleaning roller and the transfer roller.

In the above embodiment, the cleaning roller has a resistance which is greater than or substantially equal to the resistance of the transfer roller. However, this is not essential, and the cleaning roller may have a resistance which is less than that of the transfer roller. The reason for this will be understood by reference to FIG. 4 where it will be noted that there exists a very thin air layer A in the region of contact between the transfer roller 5 and the cleaning roller 6, and a voltage drop $V_D$ across the resistance of the air layer A and the resistance of the cleaning roller 6 produces an attraction of the toner. Such an air layer will be eliminated when both rollers are urged against each other with a pressure on the order of several kilograms per square centimeter, but remains or is maintained when a normal pressure of one kilogram per square centimer is employed. As a consequence, it can be said that the transfer of the toner from the transfer roller 5 to the cleaning roller 6 takes place independently from the resistance of the transfer roller 5 and is solely determined by the resistance of the cleaning roller 6.

Figure 5:
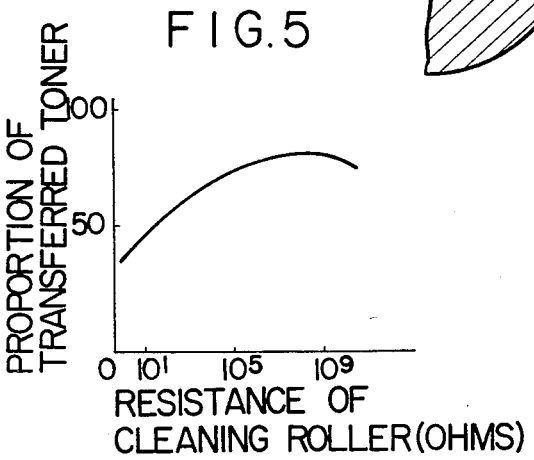
FIG. 5 graphically shows the proportion of the transferred toner as a function of the resistance of the cleaning roller.

Referring to FIG. 5, it will be seen that when the resistance of the cleaning roller is too low as will be the case with a metallic roller, the proportion of transferred toner will be reduced. It follows therefore that a roller having a certain high value of resistance, such as a roller of an electrically conductive rubber, is preferred. However, an excessively high resistance results in charging the roller surface, again reducing the proportion of transferred toner.

Figure 6:
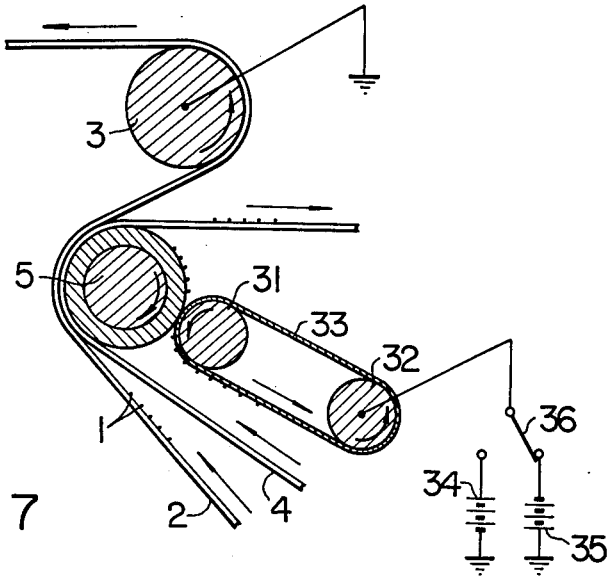
FIGS. 6 and 7 are schematic views illustrating other embodiments of the invention.

FIG. 6 shows an arrangement for another embodiment of the invention. This embodiment differs from the first mentioned embodiment in that the cleaning roller is replaced by an assembly comprising a pair of electrically conductive (metallic) rollers 31 and 32, and a belt 33 formed of an electrically conductive rubber which extends around these rollers 31, 32. The conductive roller 32 is connected with a pair of d.c. high bias voltage sources 34, 35 of opposite polarities through a switch 36. The function of these elements is similar to those mentioned above and therefore will not be repeated.

Figure 7:
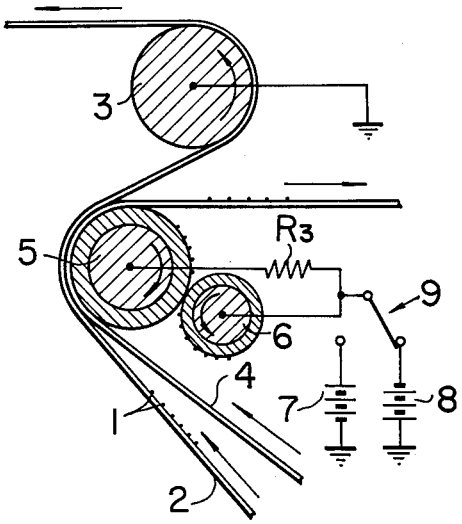
Figure 8:
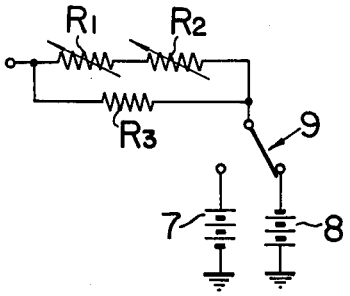
FIG. 8 is a circuit diagram showing the equivalent circuit of the embodiment shown in FIG. 7.

FIG. 7 shows an arrangement which represents a further embodiment of the invention. In this embodiment, a bias voltage is applied to the transfer roller through a cleaning roller and also through a separate resistor $R_3$ in order to prevent any significant change in the bias voltage applied to the transfer roller or a resulting degradation in the transfer efficiency in the event the resistance of the roller undergoes a considerable change as result of the deposition of the toner onto the transfer roller and the cleaning roller. The electrical equivalent circuit is shown in FIG. 8, where it will be noted that the resistance $R_1$ of the transfer roller and the resistance $R_2$ of the cleaning roller will vary as the toner attaches to the roller surface, with a corresponding change in the bias voltage applied. Since the initial value of the bias voltage is chosen so as to provide an optimum transfer efficiency, a change of the bias voltage from such value implies a reduction in the image transfer efficiency. The connection of the resistance $R_3$ between the transfer roller and the bias source will compensate for any change in the values of the resistance $R_1$ and the resistance $R_2$ so as to maintain the bias voltage in a range which prevents a reduction in the image transfer efficiency.

In the three embodiments described above, the photosensitive member used is in the form of a belt, but is should be understood that a drum-shaped photosensitive member may be used as well. The polarity of the bias voltage is determined by the characteristic of the photoconductive film on the photosensitive member used. Where a selenic photosensitive member is used, it is charged to the positive polarity when the member is uniformly charged, so that the bias voltage during the transfer step is also or the positive polarity and is switched to the negative polarity during the cleaning step. Conversely, when the photosensitive member comprises a material such as zinc oxide, it is charged to the negative polarity initially, so that the bias voltage applied during the transfer step will be of the negative polarity and is switched to the positive polarity during the cleaning step.

In the above description, the back transfer of the toner which attaches to the cleaning means to the photosensitive member is performed subsequent to the completion of the image transfer, but may be performed after the termination of a copying cycle or cycles.

What is claimed is:

1. A transfer unit for use in an electrophotographic copying machine of the type having a photosensitive member on which a toner image is formed, said unit comprising:

electrically conductive transfer roller means for pressing a transfer sheet against the photosensitive member for transferring a toner image formed on the photosensitive member onto said transfer sheet;

electrically conductive, rotatable cleaning means disposed in abutting relationship with the toner transfer roller means, for cleaning toner therefrom;

electrical bias means for producing a bias voltage of switchable polarity; and switching means, connecting said bias means to said cleaning means during the transfer of the toner image onto the transfer sheet, for applying a bias voltage of the opposite polarity from that of the toner to the transfer roller means through the cleaning means, such that the toner attaching to the transfer roller means is electrostatically transferred to the cleaning means to clean the transfer roller means, and after completion of an image transfer step, for switching the bias voltage applied to the cleaning means to the same polarity as that of the toner to transfer the toner attaching to the cleaning means back to the photosensitive member through the transfer roller means, thus cleaning both the cleaning means and the transfer roller means while leaving the toner to be subsequently cleaned from said photosensitive member.

2. A transfer unit according to claim 1 in which the cleaning means has a peripheral length which is different from the peripheral length of the transfer roller means, thereby preventing the toner attaching to the transfer roller means from being concentratedly deposited on a particular location on the surface of the cleaning means.

3. A transfer unit according to claim 1 in which the bias means comprises a compensation resistor.

4. A transfer unit according to claim 1 in which the cleaning means comprises a surface formed of an electrically conductive rubber.

5. A transfer unit according to claim 1 in which the cleaning means comprises a roller.

6. A transfer unit according to claim 1 in which the cleaning means comprises an endless belt extending around rollers.

7. A transfer unit for use in an electrophotographic copying machine of the type having a photosensitive member on which a toner image is formed, said unit comprising:

electrically-conductive transfer roller means for pressing a transfer sheet against the photosensitive member to transfer a toner image formed on the photosensitive member onto said transfer sheet;

electrically-conductive rotatable cleaning means disposed in abutting relationship with the toner transfer roller means, for cleaning toner therefrom;

first means for connecting a first bias voltage of switchable polarity to said transfer roller means;

second means for connecting a second bias voltage of switchable polarity to said cleaning means, said second bias voltage being greater than said first bias voltage; and switching means, connected to said first and second connecting means, for applying said first and second bias voltages with a polarity opposite to that of the toner respectively to said transfer roller means and said cleaning means such that the toner attaching to the transfer roller means is electrostatically transferred to the cleaning means to clean the transfer roller means during the transfer of the toner image onto the transfer sheet, and after completion of an image transfer step, for applying said first and second bias voltages with the same polarity as that of the toner respectively to said transfer roller means and said cleaning means such that the toner attaching to the cleaning means is electrostatically transferred back to the photosensitive member through the transfer roller means, thus cleaning both the cleaning means and the transfer roller means while leaving the toner to be subsequently cleaned from said photosensitive member.

8. A transfer unit as in claim 7 wherein said cleaning means has a peripheral length which is different from the peripheral length of the transfer roller means, thereby preventing the toner attaching to the transfer roller means from being concentratedly deposited on a particular location on the surface of the cleaning means.

9. A transfer unit as in claim 7 wherein said first bias means comprises a compensation resistor.

10. A transfer unit according to claim 7 wherein said cleaning means comprises a surface formed of an electrically-conductive rubber.

* * * * *